US005918530A

United States Patent [19]

Kanton et al.

[11] Patent Number: 5,918,530

[45] Date of Patent: Jul. 6, 1999

[54] HYDRAULIC ROTARY ACTUATOR

[75] Inventors: Fred Kanton, Rjukan; Øystein Klonteig, Miland, both of Norway

[73] Assignee: Scana Skarpenord AS, Rjukan, Norway

[21] Appl. No.: 08/849,558

[22] PCT Filed: Dec. 5, 1995

[86] PCT No.: PCT/NO95/00223

§ 371 Date: Aug. 6, 1997

§ 102(e) Date: Aug. 6, 1997

[87] PCT Pub. No.: WO96/18043

PCT Pub. Date: Jun. 13, 1996

[30] Foreign Application Priority Data

Dec. 5, 1994 [NO] Norway ..... 944693

[51] Int. Cl.[6] ..... F01B 3/00

[52] U.S. Cl. ..... 92/33; 92/31

[58] Field of Search ..... 92/31, 32, 33

[56] References Cited

U.S. PATENT DOCUMENTS

| | | | |
|---|---|---|---|
| 2,705,592 | 4/1955 | Reiser | 92/33 |
| 2,932,206 | 4/1960 | Tootle | 92/33 |
| 4,196,654 | 4/1980 | Sterns | 92/33 |
| 4,882,979 | 11/1989 | Weyer | 92/33 |
| 5,046,402 | 9/1991 | Lagace | 92/33 |
| 5,241,895 | 9/1993 | Weyer | 92/31 |

FOREIGN PATENT DOCUMENTS

| | | | |
|---|---|---|---|
| 0034069 | 8/1981 | European Pat. Off. | F15B 15/22 |
| 3918400 | 6/1989 | Germany | F15B 15/06 |

*Primary Examiner*—Thomas E. Denion
*Attorney, Agent, or Firm*—Lorusso & Loud

[57] ABSTRACT

A hydraulic torque motor comprising a cylindrical housing (1), a piston (30) which can only be moved axially in the housing (1) and a rotor (20) which can only be rotated and which extends through the piston (39). The rotor (20) has a spiral groove (21) and the piston (30) has an engagement element (39) which extends radially inward in the groove (21). The piston (30) has a cylindrical section (31), each end of which has a circular end flange (34, 35), which abuts sealingly and slidingly against the housing's (1) boring. The housing (1) has a center flange (5) which projects radially inwards between the end flanges (34, 35) and is arranged to abut slidingly against the cylindrical piston section (31). The end flanges (34, 35) and the center flange (5) and those sections of the housing's (1) boring which are located between the flanged (5, 34, 35) define two cylinder spaces (37, 38).

2 Claims, 2 Drawing Sheets

HYDRAULIC ROTARY ACTUATOR

BACKGROUND OF THE INVENTION

The invention relates to a hydraulic torque motor comprising a housing with a central boring, an annular piston, which can be moved axially in the housing's boring, but which is prevented from rotating about its longitudinal axis in this boring and a substantially cylindrical rotor which extends axially through the piston, and which can rotate about its longitudinal axis in the housing, but cannot be moved axially in relation thereto, there being provided in the rotor's outer surface at least one spiral groove and the piston has at least one engagement element which extends radially into the groove, the housing's boring together with one end section of the piston partially defines a first cylinder space and together with the piston's second end section partially defines a second cylinder space, the cylinder spaces are arranged for alternate connection with a source and a reservoir for a pressure fluid for movement of the piston axially between two end positions in the housing and thereby rotation of the rotor between two associated angle positions via the engagement element, at each end of the piston there is a radially outwardly projecting end flange which is arranged for sealing and sliding abutment against the housing's boring, and the housing has a centre flange which at the central area of the housing's boring, considered in the axial direction, projects radially inwards, and which works in conjunction with a section of the piston between the end flanges.

DESCRIPTION OF THE PRIOR ART

In torque motors of this kind the housing can be connected to a stationary part such as a valve body and the rotor is connected to the valve element, the valve element being rotatable for opening or closing of the valve.

A torque motor of the above-mentioned type is known, e.g. from DE 39 18 400. In this torque motor the cylinder spaces are defined by the rotor, which causes the hydraulic fluid to come into direct contact with the spiral groove and the engagement element inserted therein, i.e. those sections or components of the torque motor which are particularly prone to wear, with the result that the hydraulic fluid can easily become polluted by particles which have been worn off these parts, and which can contribute to a reduction in the working life of the motor and increase the need for its maintenance.

Since the rotor is instrumental in defining the cylinder spaces, i.e. it comes into contact with the hydraulic fluid, and the groove is not open at the ends of the rotor, the rotor cannot simply be replaced with a rotor with a differently shaped groove, e.g. with a different pitch in order to obtain a rotary distance of a different length. Thus this torque motor cannot easily be adapted to, e.g., valves with different strokes.

Furthermore from EP application no. 34069 there is known a torque motor with a housing which has a centre part with coarse, internal screw threads. The cylinders are screwed fast to each side of the centre part. In the cylinders' heads there are mounted bearings for a spindle. A piston with coarse, external threads is screwed into the centre part and has internal, axially extending splines which engage with corresponding, external splines of the spindle. The piston can rotate about its own longitudinal axis. The pitch of the threads together with the pistons' axial movement in the cylinder determine the spindle's rotation.

With this torque motor none of the components can be replaced for alteration of the torque motor's characteristics such as the required torque, rotary strokes and the like, without the hydraulic system being opened. Even though no alteration can be obtained of the motor's characteristics by replacing a spindle, even a replacement of this kind cannot be carried out without the hydraulic system being opened. The only alternative is replacement of the entire torque motor. Nor can the spindle be secured to the torque motor's housing in order to prevent rotation of the spindle and the bodies which are operated thereby when the pistons have been moved axially to a desired position. Moreover no device is described whereby an indication can be obtained when the end of the torque motor's stroke has been reached.

SUMMARY OF THE INVENTION

The object of the invention is to provide a torque motor of the type mentioned in the introduction which is not encumbered by the above-mentioned disadvantages.

The characteristics of the torque motor according to the invention are indicated by the characteristic features presented in the claims.

BRIEF DESCRIPTION OF THE DRAWING

The invention will now be described in more detail with reference to the drawing which illustrates an embodiment of a torque motor according to the invention.

DETAILED DESCRIPTION OF THE INVENTION

Figure 1:
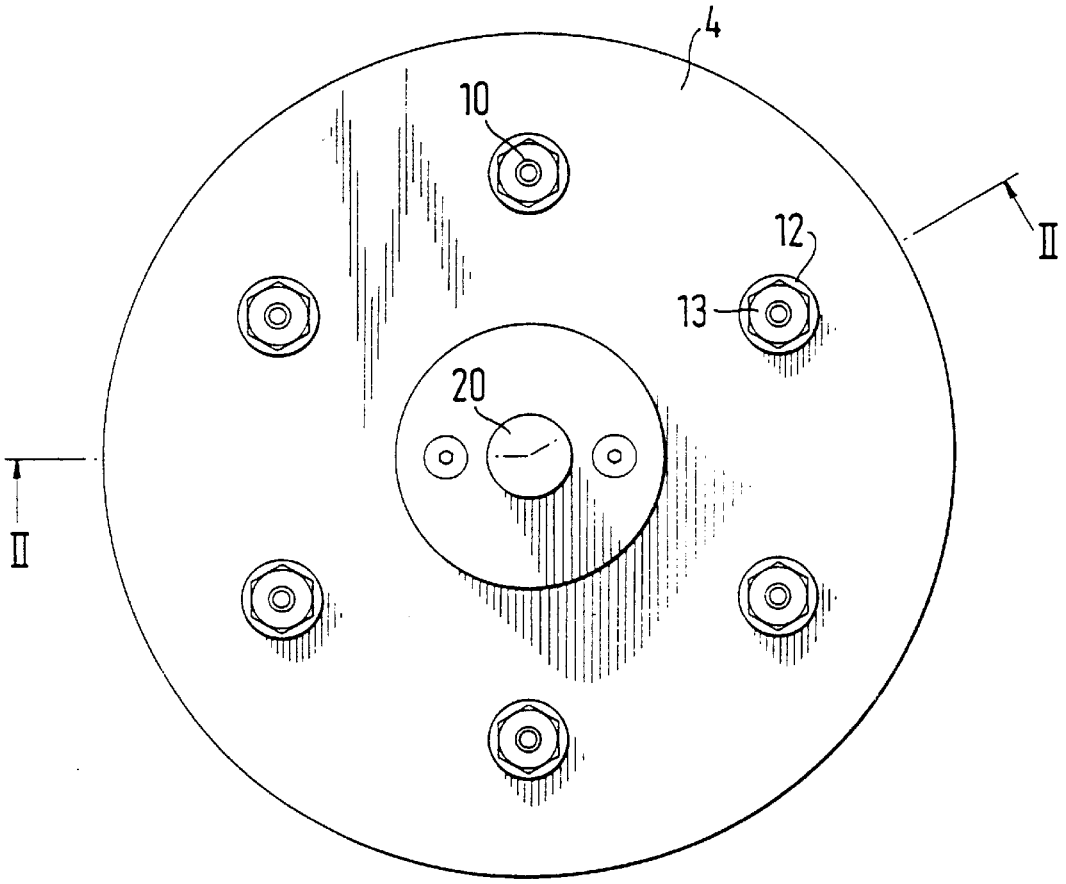
FIG. 1 is a diagram of a torque motor viewed in the direction of one of its end sections.

In the following, the expressions "upper" and "lower" with reference to FIG. 2 will imply the relative location of sections and the like closer to the edge of the page of the drawing which faces away from and towards the reader respectively.

As indicated in the figures the torque motor according to the invention has a cylindrical housing 1 which comprises a cylindrical lateral wall 2 and a lower and an upper end wall 3 and 4 respectively. Radially inwards from the section of the cylindrical lateral wall which is located substantially halfway between the ends, thereof, there extends a circular centre flange 5 with a circular, central boring 6.

In opposite recesses which extend coaxially in relation to the housing's lateral wall 2, in the housing's lower and upper end walls 3 and 4 respectively there are radially secured axial bearings 7,8, whereby there is mounted a rotor 20. The rotor's end sections have a reduced diameter and project into an axially extending, through-going, central boring 14,15 in the respective end walls 3,4.

The bearings 7,8 are located with one side abutting against respective, axial shoulders at the rotor's end sections and with their other side against opposite surface sections of the recesses in the end walls 3,4. Through each of a number of axial borings 9 which extend through the upper end wall 4, there extends a screw 10, whose lower end section is screwed into threaded blind borings 11 in the lower end wall 3. On the upper end section of the screw 10 which projects above the upper end wall 4, there is passed a disc 12 and thereafter a nut 13 is screwed on, thus securing the end walls 3,4 via the disc 12 and to some extent pressing them against each other, and the rotor 20 can be turned, but not moved axially in relation to the housing 1.

In the rotor's cylindrical outer surface there is provided a spiral groove 21, whose ends 22 at the respective ends of the rotor 20 however extend substantially axially and are connected to the spiral section of the groove via a curved groove section 23.

The rotor 20 has an axially through-going, central boring 24. In its lower section there is attached a sleeve or adaptor 25 which is arranged for attachment to a rotor of a valve (not shown), with the possibility of providing in the adaptor's inner wall an axially extending groove, which is adapted to axially extending teeth of the valve rotor's shaft. The valve body can be arranged for attachment to the torque motor's housing 1, e.g. via screws (not shown) which can be screwed into threaded borings 26 in the housing's lower end wall 3.

Between the housing's cylindrical lateral wall and the rotor's cylindrical outer surface there is provided a substantially cylindrical piston 30. This comprises a cylindrical connecting section 31 which extends coaxially with the rotor 20 and the housing 1. To the connecting section's lower end section there is attached by means of screws 32 a lower or first circular end flange 34, and to its upper end section there is attached by means of screws 33 an upper or second circular end flange 35. The end flanges 34,35 project radially outward from the piston's cylindrical connecting section 31 to close to the radially inner surface of the housing's cylindrical lateral wall 2. The piston 30 is provided in the housing 1 in such a manner that the end flanges 34,35 extend on each side of the housing's centre flange 5, considered in the housing's axial direction. The housing's lateral wall 2 and the centre flange 5 together with the piston's cylindrical connecting section 31 and the lower together with the upper end flange 34,35 define a lower and an upper annular cylinder space 37 and 38 respectively.

In the piston there are provided through-going, axial borings 36 corresponding to the borings 9 in the upper end wall, the screws 20 with clearance also extending through the borings 36. Thus the piston can be moved axially, but cannot rotate in the housing 1.

There extends radially inwards from the piston 30 at least one engagement element 39 which can be in the form of a cylindrical pin or the like, which projects into the groove 21 of the rotor, as there can be only a small clearance between the pin 39 and the lateral walls of the groove.

In an annular groove in the radially inwardly facing, cylindrical surface of the boring 6 of the housing's centre flange 5, there is provided a ring joint, e.g. an O-ring 50 which provides a seal between the centre flange 5 and the opposite cylindrical connecting section 31 of the piston 30. Furthermore in radially outwardly open grooves formed in the radially outwardly facing, cylindrical surfaces of the lower and the upper end flange 34,35, there is provided a ring joint, e.g. an O-ring 51 and 52 respectively, which provides a seal between the end flanges 34,35 and the lateral wall 2 of the housing 1.

In the housing 1, e.g. in its centre flange 5, there extend channels 53,54 which lead into the respective lower and upper cylinder spaces 37,38, and which can be connected to a source and a reservoir and vice versa (not shown) for a pressure fluid, thus enabling the piston to be moved upward or downward in the housing 1. By means of the pin 39, the rotor 20 is hereby forcibly rotated in relation to the housing 1.

In radially outwardly open, circumferential grooves which are provided in the rotor's end sections, there are fitted packings, e.g. O-rings 55 and 56 respectively which abut against opposite, radially inwardly facing surfaces of the borings 14,15 in the end walls 3,4, thus preventing dirt from the space outside the torque motor from reaching the axial bearings 7,8.

Since the cylinder spaces 37,38 are not defined by the radially outer surface of the rotor in which the spiral groove 21 is provided, hydraulic fluid does not come into contact with this groove during the operation of the torque motor.

Due to the axially extending groove section 22 of the groove 21, rotation of the rotor 20 can be prevented, i.e. the rotor is locked when the piston is located in the upper or lower end position in the housing and a torque is exerted on the rotor from outside, i.e. not from the motor's piston 30, whereby a valve spindle which may be connected to the rotor will also be locked.

The upper bearing 8 can be easily removed by first removing the nuts 13 and the discs 12 and then the upper end wall 4 from the housing 1. The rotor can then be removed from the piston and the pin 39 by gripping the upper section of the rotor 20 and rotating the rotor in relation to the housing, thus causing it to be moved axially up and out of it until the pin 39 can finally be removed from the groove via the groove's open end. Thereafter a rotor, e.g., with a groove with a different pitch can be inserted into the housing, the pin 39 first being inserted into the groove's open end, whereupon the axial bearing 8 is put into position and the upper end wall 4 is attached to the housing by screwing the nuts 13 on to the screws 10. The replacement of rotor and bearings can therefore be performed without the necessity of emptying hydraulic fluid from the cylinder spaces.

The ease with which the rotors are replaced also permits easy replacement of the torque motor's hydraulic components while the rotor is still used, e.g. changing to a larger housing and piston which, e.g., provide a greater torque than the original housing and piston.

It is stated above that the rotor 20 extends coaxially through the piston 30, but it will be understood that it only requires to extend axially in relation thereto, i.e. in the piston's direction of movement.

Even though a double-acting torque motor has been described above, it will be understood that it can be single-acting by providing a return spring for the piston.

By providing additional axially extending groove sections, a locking can be achieved of the rotor and of a device driven thereby, e.g. a valve stem, in positions between the completely open and the completely closed positions of the valve.

Figure 2:
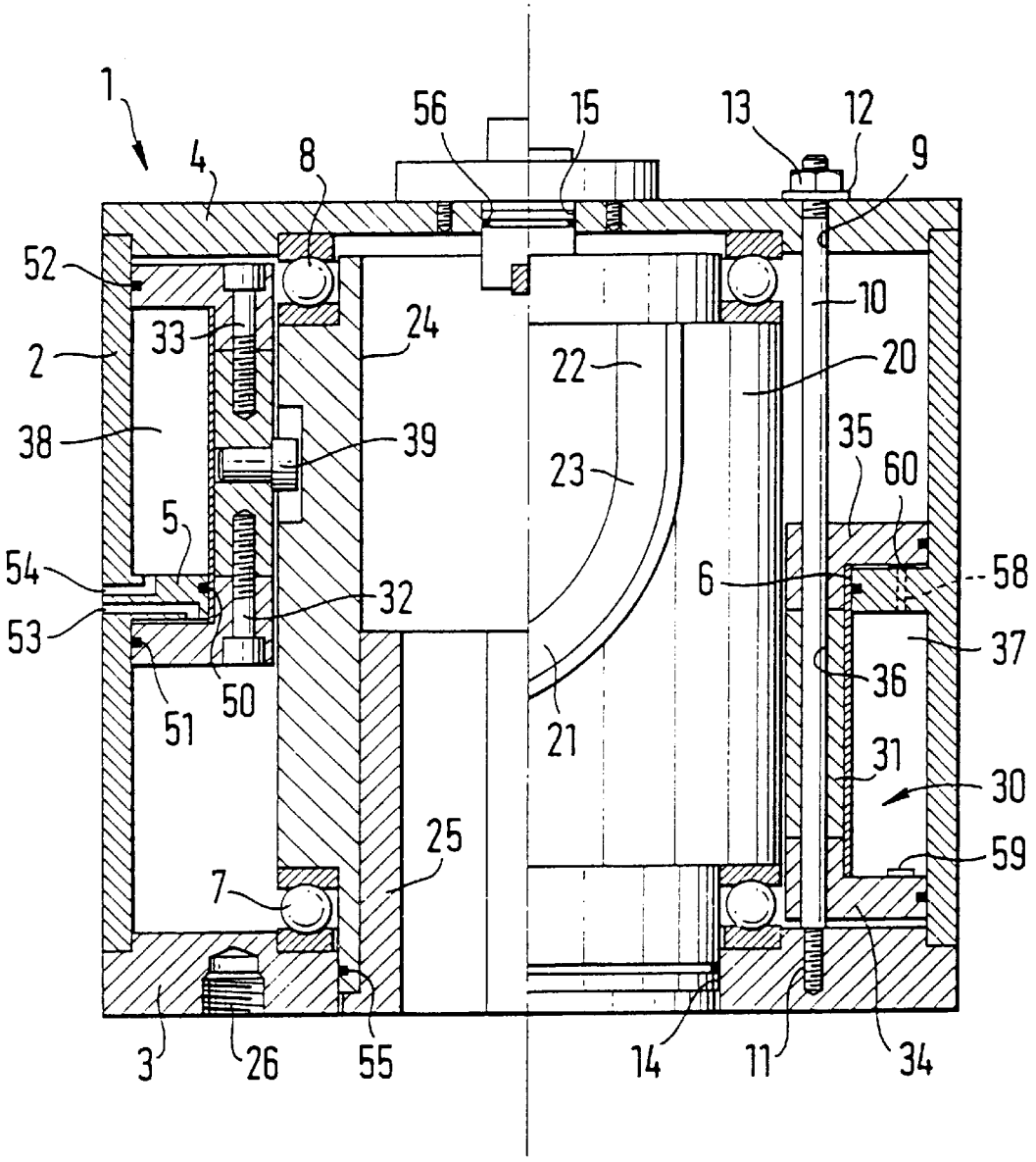
FIG. 2 is a section along line II—II through the torque motor which is shown in FIG. 1, a piston of the torque motor on the left of the torque motor's longitudinal axis being illustrated in an upper position, and in a lower position on the right of this longitudinal axis.

In order to give the operator of the torque motor an indication as to whether the piston has reached an end position in the housing 1, e.g. in order to denote that a valve which is connected to the torque motor has reached the completely closed position, an axial leakage boring 58 with a small diameter can be provided in the housing's centre flange 5, as indicated by a dotted line in FIG. 2. Moreover there can be provided on sides of the end flanges 34,35 which face each other, closing or seat areas 59,60, which are arranged to abut against respective openings of the boring 58 and seal it when the piston 30 is located in an end position and one of the end flanges 34,35 is located close to the centre flange 5.

The boring 58 is so small that a leakage of fluid to the reservoir through it does not noticeably affect the function of the torque motor when a pressure fluid is added to one of the cylinder spaces from a pressure fluid source for operation of the torque motor. By measuring the pressure of the fluid in the return pipe to the fluid reservoir, however, it can be established thereby that the pressure of the return fluid is greater than the pressure in the reservoir.

After the piston has reached the desired end position and the valve has consequently been closed, one of the closing areas 59,60 has abutted against the opening of the boring 58. The leakage of fluid has thereby been stopped and the pressure of the fluid in the return pipe has been reduced to the pressure of the fluid in the reservoir due to the missing small supply of pressure fluid. This pressure reduction which can be established by means of a pressure gauge, thus informs the operator that the valve is located in the closed position.

We claim:

1. A hydraulic torque motor comprising a housing with a central boring, an annular piston, which can be moved axially in the boring, but which is prevented from rotating about its longitudinal axis in the boring, a substantially cylindrical rotor which extends axially through said piston, and which can rotate about its longitudinal axis in said housing, but cannot be moved axially in relation thereto, there being provided in the outer surface of said rotor at least one spiral groove, said piston having at least one engagement element which extends radially into said spiral groove, a radically outwardly projecting end flange at each end of the piston which is arranged for sealing and sliding abutment against the boring, and said housing and having a center flange which at the central area of the boring, projects radially inward as reviewed in the axial direction of the boring, and which functions in conjunction with a section of said piston between said end flanges, and axial rods having ends fixedly connected to end walls wherein said center flange having a central cylindrical boring whose diameter is adapted to the diameter of said cylindrical piston section between said end flanges, and which is arranged for sealing and sliding abutment against said piston section, said center flange and said end flanges together with said sections defining respective first and second cylinder spaces arranged to alternately contact a pressurizing fluid for the movement of said piston axially between two end positions in said housing and thereby rotate said rotor between two associated angle positions via said engagement element, whereby the axial rods, the ends of which are fixedly connected with the respective end walls are slidingly extended through respective axial borings in said flanges and the section therebetween.

2. A torque motor according to claim 1, characterized in that in the center flange there is provided an axially extending leakage boring interconnecting the cylinder spaces and that on sides of the end flanges opposite each other there are provided closing areas which are arranged for closing of the leakage boring when the piston is located at an end position in the housing.

* * * * *